United States Patent [19]

Ullman

[11] Patent Number: 4,609,101

[45] Date of Patent: Sep. 2, 1986

[54] MULTI-UNIT PACKAGE

[75] Inventor: John E. Ullman, Huntingdon Valley, Pa.

[73] Assignee: The Mead Corporation, Atlanta, Ga.

[21] Appl. No.: 429,981

[22] Filed: Sep. 27, 1982

Related U.S. Application Data

[62] Division of Ser. No. 683,611, May 5, 1976, Pat. No. 4,365,456.

[51] Int. Cl.[4] ..... B65D 65/14; B65D 65/18

[52] U.S. Cl. ..... 206/45.33; 206/432; 206/497

[58] Field of Search ..... 206/497, 45.33, 432, 206/471; 53/477, 228, 433, 557, 329

[56] References Cited

U.S. PATENT DOCUMENTS

| | | | |
|---|---|---|---|
| 2,955,400 | 10/1960 | Levkoff | 53/228 |
| 3,031,072 | 4/1962 | Kraut | 53/433 X |
| 3,347,365 | 10/1967 | Funkhouser | 206/432 X |
| 3,736,723 | 6/1973 | Lattke | 53/557 |
| 3,890,763 | 6/1975 | Ullman | 53/329 X |
| 4,036,362 | 7/1977 | Ullman | 206/497 X |
| 4,094,406 | 6/1978 | Zietzschmann | 206/497 X |

*Primary Examiner*—Horace M. Culver
*Attorney, Agent, or Firm*—B. J. Powell

[57] ABSTRACT

A multi-unit package with a paperboard tray carrying a plurality of articles over which extends a flexible film sheet whose opposite ends overlap the upstanding side walls of the tray. The overlapping ends of the film sheet are bonded to the tray by their own substance under heat and pressure. The film sheet may be heat shrunk to keep it taut.

3 Claims, 13 Drawing Figures

FIG. 5
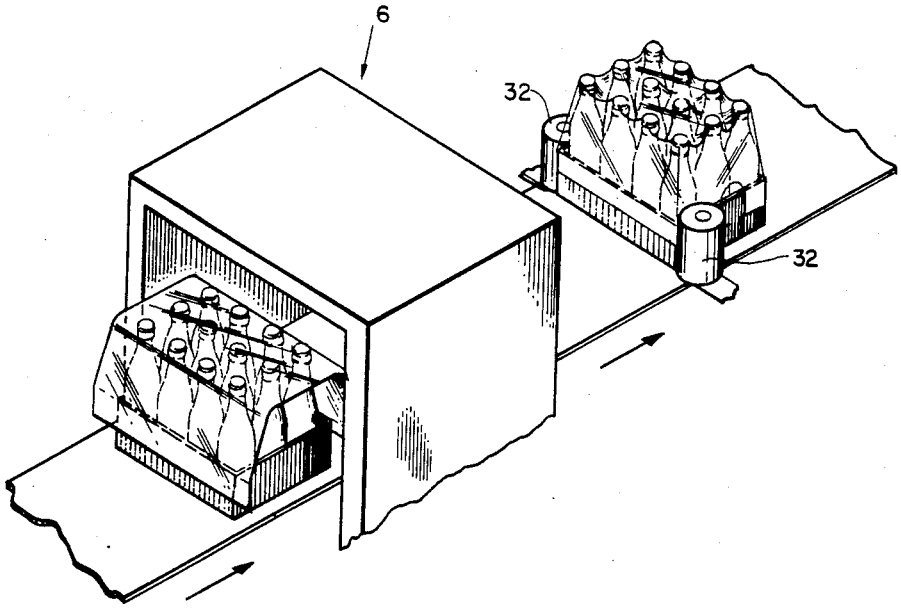
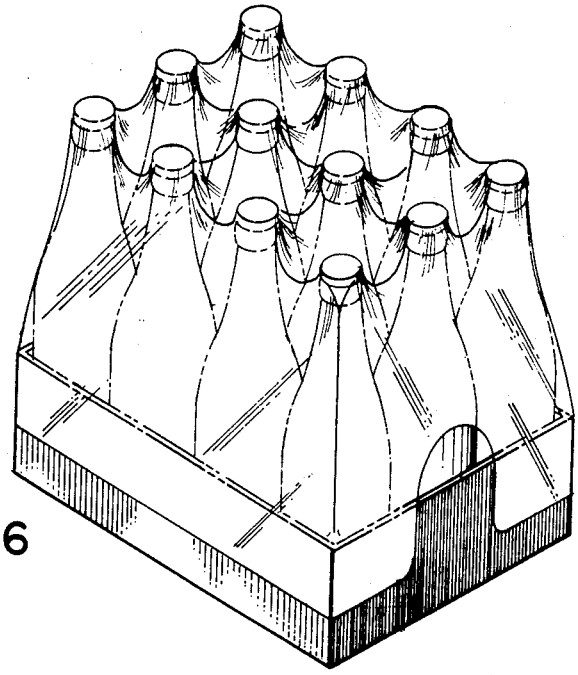
FIG. 6

OFF
ON
124
126
122
STOP
START
128
130
132
MAIN DRIVE
134
CONNECTING CONV
JOG
158
132a
134a
136a
137
PHOTO CELL
136
A B C D E F G H
83
PHOTO CELL
140
A B C D E F G H
149
148
151
118
148c
114
116
150c
120b
144
150
120
142
146
120a
152a
152
156a
158a
158b
158c
156
154
154a
148a
93a
BRAKE
OFF
MAN
AUTO.
150a
95a
BRAKE
160
163
84a
161
162
CLUTCH A
1 2 3 4 5 6 7
LOW
146a
HIGH
146b
149a
92a
CLUTCH B
1 2 3 4 5 6 7
LOW
146c
HIGH
146d
151a
94a

MULTI-UNIT PACKAGE

This application is a divisional of my application Ser. No. 683,611, filed May 5, 1976, now U.S. Pat. No. 4,365,456 which is incorporated herein by reference.

BACKGROUND OF THE INVENTION

1. Field of the Invention

This invention relates to machines for packaging articles such as cans, bottles, cartons and the like in each of a series of trays. The invention relates particularly to packaging machines that are operative, in sequence, to draw a film sheet from a roll of the film over the articles in a tray, to cause the sheet to adhere to at least one pair of opposite tray walls, and to hold the articles in the tray.

2. Description of the Prior Art

Machines for packaging articles of various kinds in a series of trays that operate in accordance with the sequence above described are known in the prior art. Such a packaging machine is disclosed in my prior U.S. Pat. No. 3,890,763 issued on June 24, 1975 and incorporated herein by reference. The packaging machine there illustrated and described, a high speed WRAPCAP machine made by Huntington Industries, Bethayres, Pa., includes a conveyor for moving a series of rectangular corrugated paperboard trays along a predetermined path. Arranged in succession along said predetermined path are a first glue station, a turning station, a second glue station, a film disposing station, and a compression station. At the first glue station glue applicators, which may be spray guns, are provided on opposite sides of the path for applying a stripe of adhesive on the outside walls (the long walls), of each tray as the latter moves past the glue applicators. Rotatable arms are provided at the turning station for rotating the tray through a right angle so that the trays then advance with the adhesion stripe on the leading and trailing walls. Additional glue applicators are provided on said opposite sides of said predetermined path at the second glue station for applying a stripe of adhesive on the outside of the other opposite walls (the short walls), of each tray. At the film disposing station a supply of film, for example of polyvinyl chloride, polypropylene or polyethylene, is provided. As the tray moves through the film disposing station, the sheet film is drawn tautly over the top of the tray. The sheet film is pulled from a constant tension unwind mechanism by a preceding tray which then is in the compression station and is being moved along by a flight bar. A succeeding flight bar pulls the sheet tautly down over the tops of the articles in the first mentioned tray and firmly against the applied adhesive on its trailing wall to form a tight band. As a result, the film sheet makes firm contact with the adhesive on the walls of the tray to form a tight bond. Cutting blades are provided in cooperative relation with the flight bars for piercing and separating the sheet between trays. After the sheet has been cut, the tray is released and is discharged from the compression station, being given a parting push by the trailing flight bar. The tray then moves on a downwardly inclined conveyor to an interconnecting conveyor which leads to a shrink tunnel. In the shrink tunnel, the heat shrinking of the sheet brings its unbonded side portions into contact with the second pair of adhesive strips to form a bond. Additionally, spring-loaded rollers are provided at opposite sides of the exit from the shrink tunnel to flatten out rough ears formed by the side portions of the sheet and to press the side portions of the sheet against the adhesive to form a better and more attractive bond. As stated in said prior patent, even when the second pair of adhesive strips is not applied to the tray walls the pressure of the rollers causes the hot ends of the sheet to adhere to the walls.

Trays packaged by the packaging machine of my aforementioned patent have a number of advantages over the conventional rectangular corrugated paperboard case, including weight savings, lower costs, locking of the articles in the tray to prevent relative movement of the articles, transparency of the covering film sheet so that labels and other information provided on the tray may be seen, absence of film sheet from the bottom of the tray, and easy removal of the articles from the tray by slitting the film.

However, the glue tends to obscure labels or other information which it overlies on the walls of the trays. The need for adhesive and adhesive apparatus adds to the cost of packaging. Also, the need for a turning station, for turning the trays through a right angle so that the adhesive striped walls are leading and trailing, adds to the complexity and size of the packaging machine.

SUMMARY OF THE INVENTION

Accordingly, it is an object of the invention to overcome the disadvantages of the prior art and to provide an improved packaging machine, packaging method, and package.

It is another object to provide a package wherein a better bond is provided between the film sheet and the tray, a bond that is more economical in that no glue or other adhesive is required for the bond, and wherein the film sheet at the bonded area is transparent so that any labels and other information on the tray under the sheet are clearly visible.

A further object of the invention is to provide an improved packaging machine which accommodates trays of different size.

A further object of the invention is to provide a method of forming a tight package of an article-filled paperboard tray in accordance with which adherence of the film sheet to the tray is produced by heat and pressure without the addition of glue or any other adhesive.

A further object of the invention is to provide an improved method of and apparatus for forming a tight package comprising a paperboard tray and a covering film sheet wherein the bond between the film sheet and tray is produced by heat and pressure alone, and wherein trays of different size are readily accommodated.

Another object is to provide an improved tight package with a film sheet bonded to the wall of a tray without an especially applied adhesive.

In accomplishing these and other objects there has been provided in accordance with the present invention an improved method of forming a tight package of rectangular paperboard trays filled with articles such as cans or bottles. The improved method comprises placing a thin polyethylene film sheet over the tops of the articles, pressing the sheet against the front and rear walls of the tray, and while so compressed heating the sheet to a sufficient temperature for a sufficient length of time to form a bond between the film sheet and the walls of the tray, and then releasing the heat and pressure. In accordance with the improved method the film sheet may be transparent or opaque, as desired. Additionally, stretch film may be used. Depending upon the character of the filled trays being packed, the film sheet may be as thin as one mil (0.001") or less, or as thick as six mils (0.006") or more. The method may also include the step of thereafter heat shrinking the film sheet around the articles to form a tight package.

In accordance with the invention the tray feed, sheet film feed, sheet film disposing or wrapping, film cutting, and compression bar mechanism of the packaging machine may be similar to that disclosed in my aforementioned U.S. Pat. No. 3,890,763. Thus, power driven means are provided to push a tray against the film sheet extending from a constant-tension film-unwind device. A succeeding flight bar pulls the film sheet tautly over the tops of the packaged articles and against the trailing wall of the tray.

In accordance with one aspect of the present invention, suitable means are provided for supplying heat to each of said flight bars. Pressure of the film sheet against the tray by the heated flight bar is effective to bond or "weld" the film sheet to the tray wall to produce a tight bond between the film sheet and the tray.

In accordance with another aspect of the present invention, the flight bars at the leading and trailing walls of each tray are independently driven, and the packaging machine is adjustable as required to accommodate trays of different size over a range of tray sizes.

BRIEF DESCRIPTION OF THE DRAWINGS

FIG. 5 is a view of a heating or shrink tunnel and of a package leaving the tunnel and shows rollers pressing the heated film sheet against the tray sidewalls to produce a bond and also to give the package a better appearance;

FIG. 6 is a view in perspective of the completed package after it leaves the shrink tunnel;

DESCRIPTION OF THE PREFERRED EMBODIMENT

Figure 1:
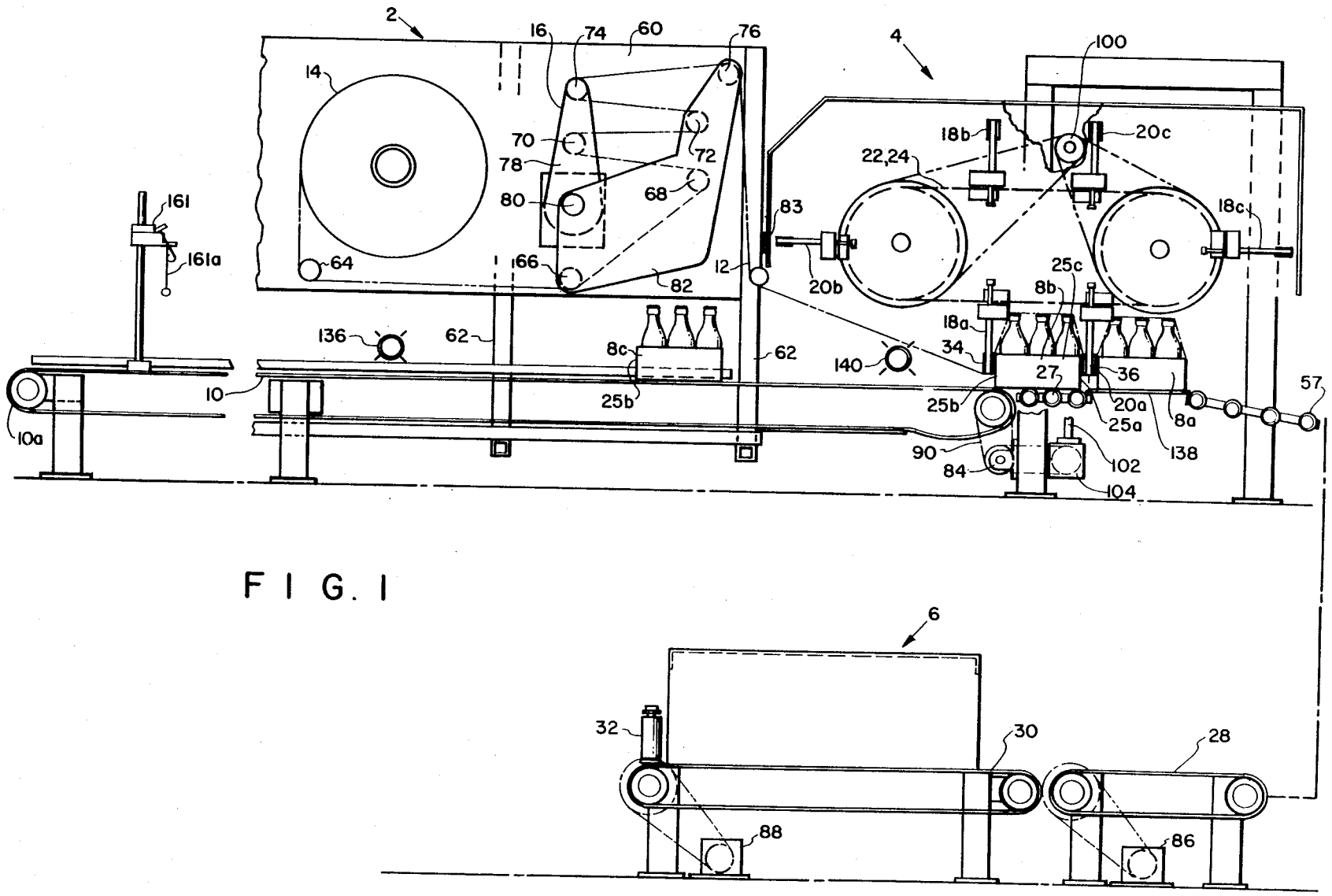
FIG. 1 is a view in elevation of a packaging machine constructed in accordance with the invention.

The packaging machine illustrated in FIG. 1 includes, in sequence along a predetermined path, a tray indexing station (not shown), a film sheet supply station 2, a compression and heat bonding station 4, and a heating station or shrink tunnel 6. At the tray indexing station, as disclosed in my aforementioned prior patent, a driven accelerator conveyor belt 10 moves filled trays 8 faster than an infeed conveyor belt 10*a* in order suitably to space the trays 8 apart prior to their introduction to the film sheet supply station 2 and the compression and heat bonding station 4. The trays are conveyed by a conveyor belt 10 from the indexing station to the film sheet supply station 2. At the film sheet supply station 2 there is provided a film sheet 12 which is arranged to be drawn from a roll 14 of the film sheet through a constant-tension film-unwinding device 16. The latter is provided to cause the film sheet 12 to be tightly drawn over the article-filled trays 8.

At the compression station 4 there are provided two sets 18 and 20 of flight bars 18*a*–18*c* and 20*a*–20*c*. The sets of flight bars 18*a*–18*c* and 20*a*–20*c* are carried by separate chains 22 and 24, respectively, as may be seen by reference to FIGS. 1 and 2. The flight bar sets 18 and 20 are driven independently of each other in an orbital path, a portion of which path is substantially coincident with the above-mentioned predetermined path. Flight bars of the two sets 18 and 20 are alternately interposed in the orbital path, as shown in FIG. 1.

In their operation, the sets of flight bars 18*a*–18*c* and 20*a*–20*c* operate alternately to push the trays 8 through the compression and heating station 4 and cooperate to place the trays 8 in compression, pressing the film sheet 12 against the leading 25*a* and trailing 25*b* walls of the trays 8 which are connected together by the shorter sidewalls 25*c*. Simultaneously, the flight bars 18*a*–18*c* and 20*a*–20*c* impart heat to the film sheet 12 and the adjacent tray walls 25*a*–25*b*, in a manner further described hereinafter in connection with the description of FIGS. 3 and 4, to effect a bond between the film sheet 12 and walls 25*a*–25*b*.

Figure 4:
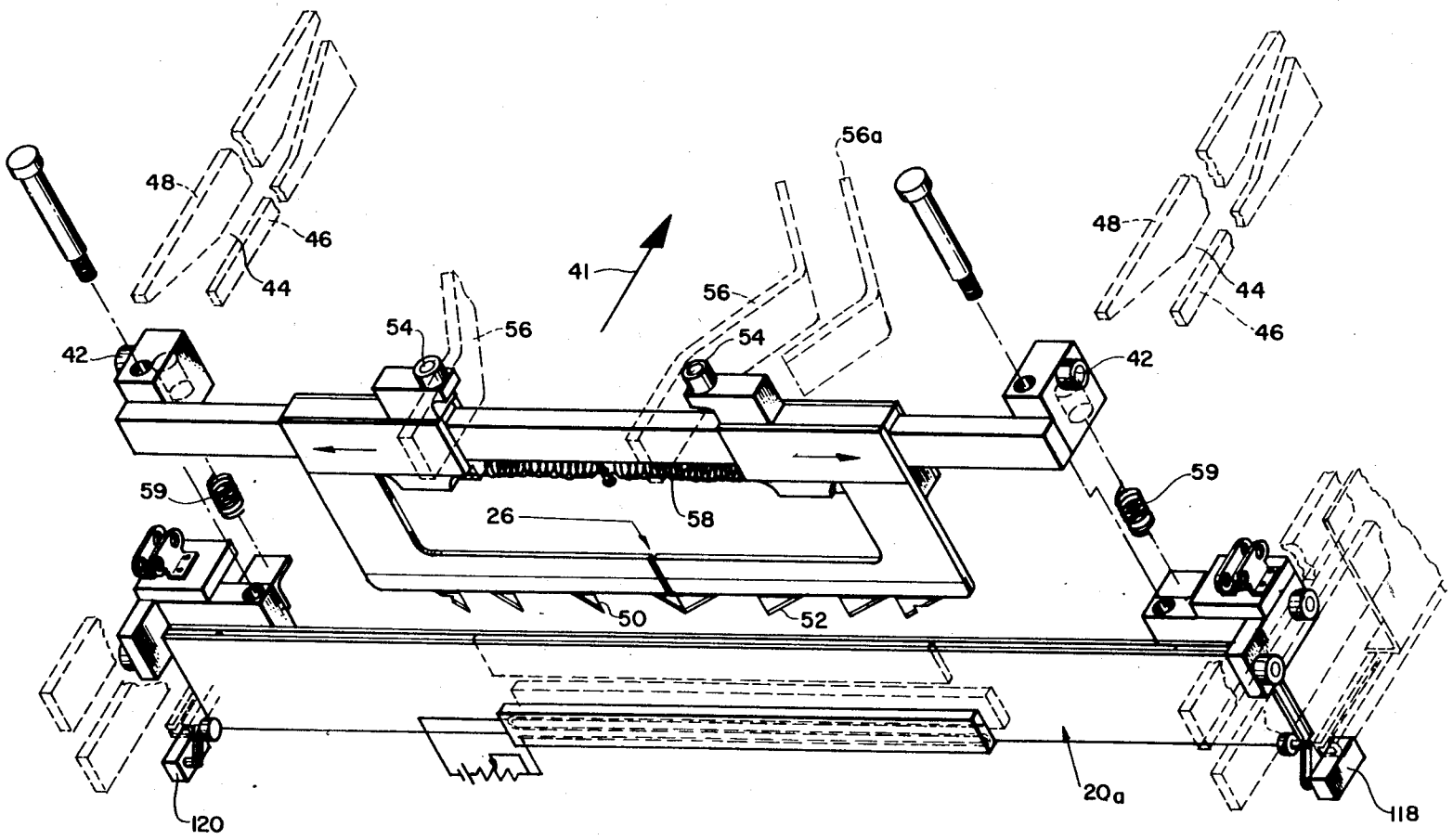
FIG. 4 is an enlarged exploded view in perspective of one of the flight bars illustrating the manner of connection of the flight bars to their drive chains, showing a heating element disposed in association with pressure pads thereof, and also showing associated sheet cutting mechanism.

The infeed conveyor belt 10*a* delivers the trays 8 to accelerator belt 10 which feeds the trays 8 first to film supply station 2 and then into compression and heating station 4 where the trays 8 are moved by flight bars 18, 20 onto a driven roller conveyor 27. Cutting blades 26 associated with the flight bars 18 and 20, as seen in FIG. 4, slice through the film sheet 12 between successive trays 8 during their course of travel through the compression and heating station 4.

Figures 8, 10, 11, 12, 13:
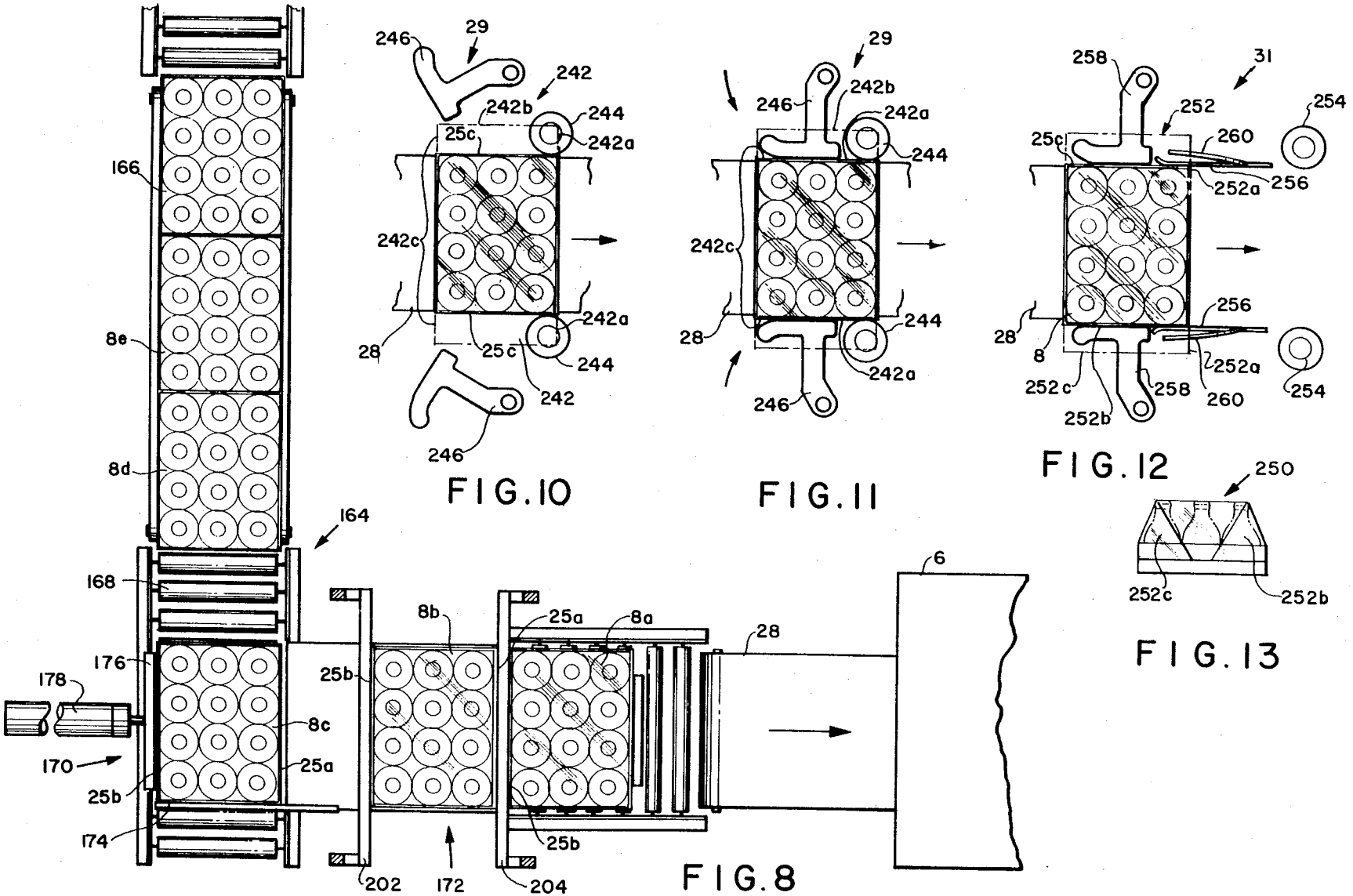
FIG. 8 is a view in top plan of another embodiment of the inventive packaging machine.
FIGS. 10 and 11 are top plan views of the mechanism for tucking the trailing sheet side portions against the sidewalls of the tray and for heat and pressure bonding the sheet side portions against the tray sidewalls.
FIG. 12 is a view in top plan of a mechanism for folding the sheet side portions neatly against the tray sidewalls and for heat and pressure bonding the side portions against the sidewalls.
FIG. 13 is a side view in elevation of a tray after passing through the mechanism of FIG. 12.

After being discharged from the compression and heating station 4, the trays 8 are moved by a connecting conveyor 28 through a sidewall bonding station 29, as illustrated in FIGS. 10 and 11, to the heating station or shrink tunnel 6. A conveyor 30 is provided for moving the trays 8 through shrink tunnel 6.

Instead of being moved through sidewall bonding station 29, the trays 8 may be moved through a sidewall bonding station 31 shown in FIG. 12 to form the completely enclosed package of FIG. 13.

The heat tunnel 6 shrinks the film sheet 12 around the articles and around the tops of the trays 8, thereby holding the articles firmly in place. If the side portions of the sheet 12 have not been bonded to the tray sidewalls, tunnel 6 shrinks the side portions of the film sheet 12 to cause the latter to overlap the sidewalls 25*c* of trays 8.

In this case, as the trays 8 emerge from shrink tunnel 6, as seen in FIG. 5, a pair of rollers 32 positioned on opposite sides at the exit of the tunnel 6 operate to press the film sheet 12 against the sidewall 25*c* of the tray 8, thereby to flatten out rough ears and also to effect a bond of the hot shrunken ends of the film sheet 12 with the tray sidewalls 25*c*, forming a package such as that shown in FIG. 6. Since no glue or other adhesive is used in the heat-compressing bonding operation, the film sheet 12, when transparent film sheet is used, is virtually transparent at the bonded or welded areas and does not obscure any labels or other information that might be provided on the tray sidewalls 25*a* and 25*b*. Additionally, the completed package has a better appearance.

In accordance with the invention, means are provided at the compression and heating station 4 to apply heat to the flight bars 18*a*–18*c* and 20*a*–20*c*. The temperature of the flight bars and the duration of the period in which they are in contact with and press the film sheet 12 into contact with the trays 8 are such as to form a bond between the film sheet 12 and the trays 8. Such a bond is formed without the addition of glue or any other separately applied adhesive, and with no tendency for the bonded area to adhere to the flight bars. In a high speed machine the temperature of the flight bars 18, 20 may be higher than in a slow speed machine, since the trays 8 and film sheet 12 are in compression only a relatively short time.

Figure 2:
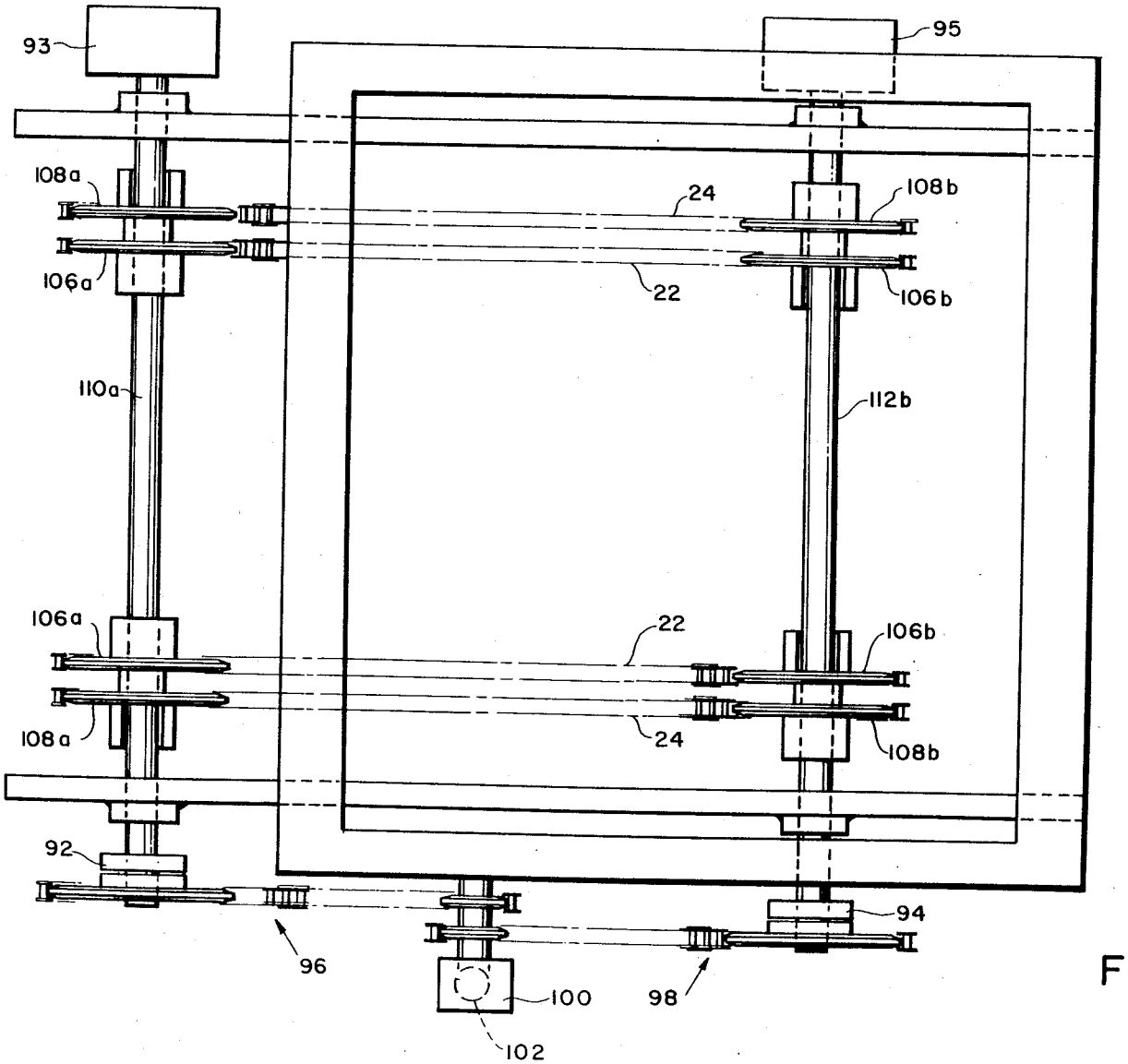
FIG. 2 is a view showing drive and idle sprockets for flight bar chains for first and second sets of flight bars, and the drive mechanism for the said drive sprockets.
Figure 3:
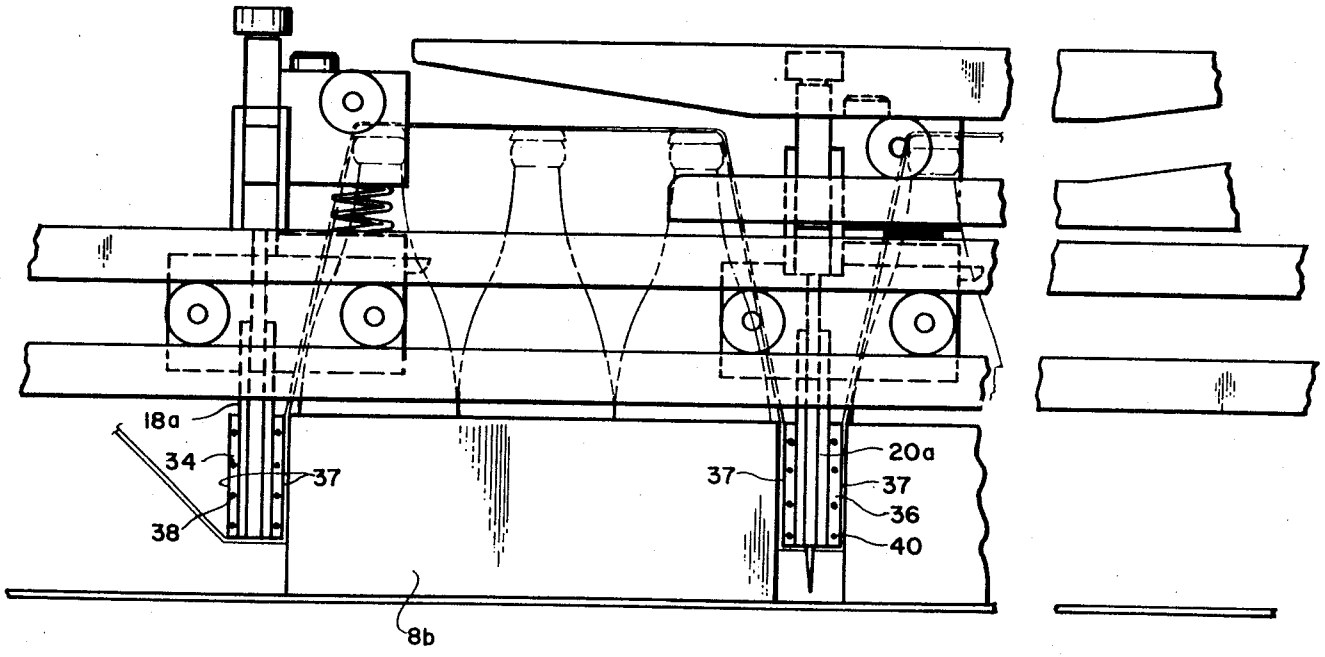
FIG. 3 is a partial view on an enlarged scale showing filled trays in the compression and heating section of the packaging machine.

Referring to FIG. 1, it is seen that the conveyor belt 10 pushes an incoming tray 8*c* against the film sheet 12 extending between the constant-tension film-unwind device 16 and a preceding tray 8*b* that is in the compression and heating station 4. As the succeeding tray 8*c* enters the compression and heating station 4, a following flight bar 20*b* pulls the film sheet 12 over the top of the articles in the tray 8*c* and subsequently also brings the film sheet 12 into firm contact with the trailing wall 25*b* of the tray 8*c*. Meanwhile, tray 8*b* that has been in the compression and heating station 4 has been under compression between a flight bar 20*a* pressed against the leading wall 25*a* and a flight bar 18*a* pressed against the trailing wall 25*b*. An enlarged view of the tray 8*b* in this state of compression is shown in FIG. 3. As there illustrated, it is seen that the flight bars 18*a* and 20*a* are each provided with pressure pads 34 and 36. The pressure pads 34 and 36 may be formed of a material such as silicone rubber which is heat resistant, a good insulator, and sufficiently resilient to apply an even pressure against the conformation of the bottles. However, in some applications, solid, non-resilient, heat resistant materials or even metal may be employed for the pressure pads 34 and 36. Encased in the pads 34 and 36 are heating elements 38 and 40. The heating elements 38, 40 are desirably formed of a heat producing, when electrically energized, resistive material such as nichrome. A cover 37 is provided for each of the pads 34 and 36. Desirably, cover 37 is made of thin fibre glass cloth impregnated with tetrafluorethylene, for example, Teflon manufactured by E. I. DuPont de Le Nemours & Co., Wilmington, Del. This Teflon-glass cloth cover 37 prevents sticking of the pressure pads 34, 36 to the hot film sheet 12. Teflon is characterized by its relative freedom from adherence to the film sheet 12 even when sheet 12 is subjected to the relatively high temperature and the pressure required to effect a bond between the film sheet 12 and the tray. This heating together with the applied pressure effects the desired bond between the film sheet 12 and the leading and trailing walls 25*a*, 25*b* of the trays 8. The manner in which the flight bars 18*a*, 18*b* and 18*c* and 20*a*, 20*b* and 20*c* are mechanically actuated and electrically heated is further described hereinafter by reference to FIGS. 2, 3 and 4.

FIG. 4 shows the means provided for separating the film sheet 12 between trays 8 as they are being moved in the direction of arrow 41 by flight bars 18, 20. These means include rollers 42 and cam tracks 44 formed by guides 46 and 48 for moving the cutting blades 26 downwardly to pierce through the film sheet 12. During the cutting operation the film sheet 12 is held tightly horizontally by the flight bars 18*a*–18*c* and 20*a*–20*c*. As shown, the cutting blades generally indicated at 26 include two sets of blades 50 and 52. The film separating means also includes vertical rollers 54 and associated cams 56 for moving the cutting blade sets 50 and 52 away from each other to cut the film sheet 12 with oppositely moving horizontal strokes. Desirably, as is described in my U.S. Pat. No. 3,890,763, a flat portion (not shown in FIG. 4) is provided on the outer ones of the blades 50 and 52 for holding and supporting the uncut portion of the film sheet 12 in position for cutting while the cutting blade sets 50 and 52 are being moved away from each other. Cams 56 move the cutting blade sets 50 and 52 away from each other against the action of springs 58. After the film sheet 12 has been cut, cutting blade sets 50 and 52 are moved toward each other by cams 56*a* and then held together by springs 58 in normal together position. Springs 58 retain blade sets 50 and 52 at their normal innermost position until entering upon cams 56 once again. The cutter assemblies are moved upwardly by the far end of lower bar 46 of cams 44 and are retained in this position by springs 59 until rollers 42 once again enter the cams 44.

After the film sheet 12 has been cut, the filled and wrapped trays 8 are discharged from the compression and heating station 4, with the rear flight bar 20*a*, as seen in FIG. 1, giving the tray 8*a* a parting push down a short section of skate wheel conveyor 57 toward the connecting conveyor 28 which leads to shrink tunnel 6.

Film sheet unwinding device 16, as seen in FIG. 1, is mounted on a frame 60 carried by uprights 62. The film sheet 12 is drawn from the roll 14 and is trained around a number of rollers indicated at 64, 66, 68, 70, 72, 74 and 76, all of which operate as parts of a rotary festooning device that allows the film sheet to be drawn smoothly and with constant tension from the roll 14. An arm 78 that supports the rolls 70 and 74 is movable through an arc about its pivot 80 and is loaded by a torsion spring (not shown) about pivot 80. Arm 78 also controls a braking device (not shown) which prevents override of the roll 14. An arm 82 that supports the rollers 66, 68, 72 and 76 is suitably mounted in a fixed position. A sensitive relay (not shown) having a feeler finger in contact with the film sheet 12 may be provided in known manner to detect any breakage or absence of the film sheet and to stop operation of the packaging machine until the condition has been corrected.

Figure 7:
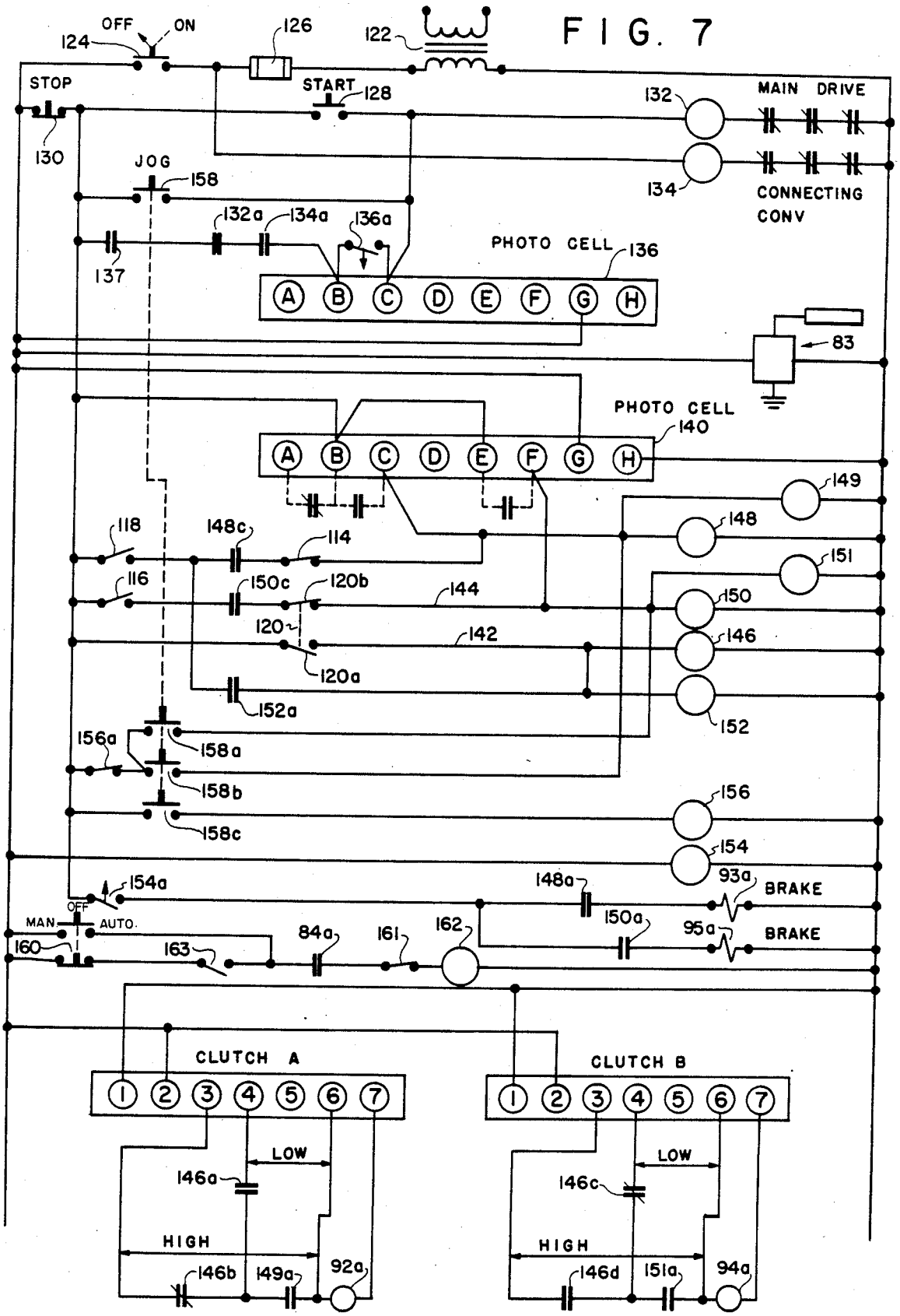
FIG. 7 is a schematic view illustrating the electrical control circuit of the packaging machine.

A static eliminator 83, as seen in FIGS. 1 and 7 and arranged in association with the film sheet 12, is employed in known manner to minimize the effects of static elasticity, the most important of which is the attraction of air borne dust and dirt to the finished package. The static eliminator transforms the voltage of an applied 115 volt electrical AC power source to a high voltage which causes the air to ionize in the vicinity of the static eliminator bar. This eliminates or reduces to an acceptable minimum value the static electricity created as the film sheet 12 unwinds from the roll 14.

As illustrated in FIG. 1, a number of separate motors are provided for driving the several conveyors. Thus, motor 84 drives the conveyor 10 to the film supply unit 2, and also drives the compression and heating unit 4. The connecting conveyor 28 is driven by a motor 86, and the conveyor 30 through the heating and shrink tunnel 6 is driven by motor 88. The electrical circuits for controlling the energization of motors 84, 86 and 88 are shown in FIG. 7.

Motor 84 drives conveyor belt 10 by means of a gear box and a chain 90. The motor 84 also powers electromagnetic clutch units 92 and 94, as seen in FIG. 2, for driving, respectively, the two sets 18 and 20 of flight bars. Specifically, as shown in FIGS. 1 and 2, the clutch units 92 and 94 are driven through individually associated chain and sprocket drive units 96 and 98, a right angle gear box 100, and a telescoping drive rod 102 from a common right angle gear box 104 provided in association with the motor 84.

Flight bars 18*a*–18*c* are driven by chains 22 which are driven by sprockets 106, as shown in FIGS. 1 and 2. Flight bars 20*a* are driven by chains 24 which are driven by sprockets 108. Thus by reference to FIG. 2, it will be seen that the sprockets 106*a* are fixedly mounted on a shaft 110*a* which, in turn, is driven by the electromagnetic clutch unit 92. The sprockets 108*a* are arranged to idle on the shaft 110*a*. Similarly, the sprockets 108*b* are fixedly mounted on a shaft 112*b*. The latter is driven by the clutch unit 94. The sprockets 106*b* idle on the shaft 112*b*.

Brake units 93 and 95, as seen in FIG. 2, are associated, respectively, with shafts 110*a* and 112*b*. These brakes desirably are of the fail-safe type, being energized by internal springs and released electromagnetically. Brake units 93 and 95 are operated in conjunction with clutch units 92 and 94 in such a manner that when either clutch unit 92 or 94 is energized to drive its respectively associated shaft 110*a* or 112*b*, the brake unit on that shaft is released to allow the shaft to turn. Conversely, when either clutch unit is deenergized to release its respective shaft, the brake unit on that shaft is electrically deenergized to cause the brake unit to stop and hold the shaft in its then position. Clutch coils 92*a* and 94*a* for the clutch units 92 and 94, as seen in FIG. 7, are supplied with power from separate DC supplies (not shown). Brake coils 93*a* and 95*a* of the brake units 93 and 95 are supplied with AC electrical power. Auxiliary relays are employed, as described in connection with FIG. 7, to isolate the DC voltage from the AC voltage. These auxiliary relays operate simultaneously with their companion relays.

The clutch units 92 and 94 and the brake units 93 and 95 are arranged to be selectively energized electromagnetically to individually drive the sets of flight bars 18 and 20 as required to push each of the successive trays 8 to the proper location in the compression and heating station 4, meanwhile trapping the appropriate length of film sheet 12 over the top of the trays 8.

Thus, the sets 18 and 20 of flight bars are each controlled through their own separate clutches and brakes. The stopping positions for each flight bar 18*a*–18*c* and 20*a*–20*c* in its orbital path is controlled by the positioning of four limit switches designated 114, 116, 118 and 120, as shown in FIGS. 4 and 7. By proper positioning of these switches, the compression and heating station 4 is adjusted to suit any size tray 8 within the range of the packaging machine.

Limit switches 114 and 116 are provided at the compression and heating station 4. Switch 114 is arranged at one side of the flight bars to control the stopping point of the flight bars 18*a*–18*c*. Switch 116 is arranged at the other side of station 4 to control the stopping of flight bars 20*a*–20*c*. Similarly, limit switches 118 and 120 are disposed at opposite sides of station 4. Switch 118 controls stopping point of flight bar sets 18, and switch 120 controls the stopping point of flight bar sets 20.

As seen in FIG. 7, the electrical control circuit of the packaging machine, a "schematic diagram", includes a power transformer 122 having a secondary winding, and a primary winding connected to a suitable commercial source of AC electric power. An "ON-OFF" selector switch 124 is connected in series with the transformer secondary winding. Adjusting the switch 124 to its "ON" position energizes the control circuitry for the packaging machine. The secondary winding of the transformer 122 and the switch 124 are connected in series, and desirably in series with a suitable fuse indicated at 126. Also connected in a circuit parallel to the transformer secondary winding are a normally open "START" switch 128 and a normally closed "STOP" switch 130 and a motor starter unit 132 for the electrical motor 84 which drives the conveyor 10 and compression station 4. A motor starter unit 134 for the motor 86 that drives the connecting conveyor 28 is also connected across the secondary winding of transformer 122. Also connected across the line in series with the normally closed "STOP" switch 130, and switch contacts 132*a* and 134*a* that close when motor starter units 132 and 134, respectively, are energized, are a switch contact 137 and a photoelectric cell 136. The photoelectric cell 136, as shown by FIG. 1, is located adjacent the front of the film supply station 2. If there is a jam in the tray infeed area, the cases back up and block the light to photoelectric cell 136 for more than the usual time, causing contact 136*a* to open and deenergize the main drive motor starter 132.

In order to start the packaging machine, the "ON-OFF" switch 124 is turned to its "ON" position. This energizes the control circuitry for the packaging machine. When the "START" switch 128 is closed, the drive motor 84 is started and is held in through switch contacts 132*a*, 134*a* and overload switch 137, causing the conveyor 10 to run. The switch contacts 137 are operated by an overload relay (not shown) and open on an overload condition of the motor.

By reference to FIGS. 1 and 3, it is seen that a tray 8*b* is under compression, with flight bar 20*a* as a leading bar and a flight bar 18*a* as a trailing bar. In addition to the tray 8*b* held under compression, another and preceding tray 8*a* is held back by the frictional surface of a dead plate 138 on which it is at rest. The film sheet 12 between the tray 8*a* and the tray 8*b* under compression has not yet been cut. As the tray 8*b* leaves the compression and heating section 4, the film sheet 12 between the two trays 8*a* and 8*b* is cut, and the tray 8*a* which had been held back by the dead plate 138 is pushed toward conveyor 28 and shrink tunnel 6.

As an incoming tray 8*c* enters the compression and heating section 4, it breaks the beam of a photoelectric cell or unit 140, FIGS. 1 and 7, and as a result, both sets 18 and 20 of the flight bars advance in their orbital path. The direction of advance, as seen in FIG. 1, is counterclockwise. The flight bars of set 18 advance until they occupy the position previously held by the flight bars of set 20, and vice versa. The flight bars of set 20, however, when in the positions shown in FIG. 1, must move a greater disance than the flight bars of set 18 in order to assume the positions held by the bars of set 18. As a next tray 8 enters the compression and heating section 4, the flight bars of sets 18 and 20 again exchange positions, with the flight bars of set 18, this time, moving the greater distance. With the flight bars in the positions shown, it is evident that greater work is required to advance the flight bars of set 18 than the flight bars of set 20, since the flight bar 20*b* receives a gravity assist and flight bar 18*c* must overcome gravity. Accordingly, in this position the flight bars of set 20 would tend to run faster than the bars of set 18, and tend to push tray 8*a* away from tray 8*b* and to pull film sheet 12 away from wall 25*a* of tray 8*b*. When the flight bars of sets 18 and 20 exchange positions, flight bar 18*b* receives a gravity assist and flight bar 20*a* must overcome gravity in the next advance in position.

In order to compensate for the difference in work alternately required to advance the flight bar sets 18 and 20, and to overcome the pullaway problem, there is provided, in accordance with the invention, means to regulate the control voltage that is applied to the clutch coils of the electromagnetic clutch units 92 and 94 according to the positions of the flight bars 18*a*–18*c* and 20*a*–20*c*. Thus, if the flight bars of set 18 are being moved "uphill", and the flight bars of set 20 are being moved "downhill", full voltage is applied to the clutch coil of the electromagnetic clutch unit 92 of set 18, and a reduced voltage is applied to the clutch coil of the electromagnetic clutch unit 94 of set 20. This is in accordance with a setting on the power supply units as will be described in connection with the electrical circuit of FIG. 7. With the flight bars of set 18 being moved "downhill" and the flight bars of set 20 being moved "uphill", the clutch coil of the electromagnetic clutch unit 92 of set 18 receives reduced power and the clutch coil of the electromagnetic clutch unit 94 of set 20 receives full power.

With the flight bars 18*a*–18*c* and 20*a*–20*c* in the positions shown in FIG. 1, the limit switches 114, 116, 118 and 120 are in the positions illustrated in the electrical circuit diagram of FIG. 7. Limit switches 116 and 118 are normally closed, but are held open in the stated position of the flight bars. Limit switch 114 is normally closed. Limit switch 120 is a double pole-double throw switch, the contact 120*a* on line 142, as seen in FIG. 7, being normally open, and the contact 120*b* on line 144 normally closed. With switch contact 120*a* open, a relay 146 is deenergized. The relay 146 is provided with normally open switch contacts 146*a* and 146*d*, and normally closed switch contacts 146*b* and 146*c*. The relay 146 determines which clutch coil 92*a* or 94*a* of the electromagnetic clutch units 92 and 94 receives either the full or the reduced voltage.

With the flight bars in the positions shown in FIG. 1, the clutch coil 92*a* of the clutch unit 92 associated with flight bar set 18 receives full power and the clutch coil 94*a* of the clutch unit 94 associated with flight bar set 20 receives reduced power. When the positions of the flight bars 18 and 20 have been interchanged, limit switch contact 120*a* is closed, thereby energizing relay 146. Now the clutch coil 92*a* of the clutch unit 92 of set 18 receives the reduced power, and the clutch coil 94*a* of the clutch unit 94 of set 20 receives full power. As those skilled in the art will understand, this is a "flip-flop" circuit which determines the mode of operation of the apparatus, providing full and reduced power for driving the sets of flight bars 18*a*–18*c* and 20*a*–20*c* as their relative positions require.

As a tray 8 enters the compression and heating station 4, a light beam to the photoelectric unit 140 is interrupted, resulting in energization of relays 148, 149, 150 and 151 having respectively associated normally open contacts 148*a*, 149*a*, 150*a* and 151*a*. Relays 149 and 151 are the auxiliary relays, previously mentioned, for isolating the DC power supplied to the clutch coils 92*a* and 94*a* from the AC power supplied to the brake units 93 and 95. When closed, switch contacts 148*a* and 150*a* complete energizing circuits to brake coils 93*a* and 95*a* of the electromagnetic brake units 93 and 95, respectively. As previously noted, the brakes 93 and 95 disengage when energized and engage when deenergized. This operation is provided to prevent the flight bars of sets 18 and 20 from shifting in position when power is removed from the brake units 93 and 95. Hence, with switch contacts 148*a* and 150*a* both closed, both brake units are disengaged.

Contacts 149*a* and 151*a* close upon energization of relays 149 and 151, respectively, to energize clutch coils 92*a* and 94*a*, thereby to engage the clutches 92 and 94.

With the flight bars of sets 18 and 20 positioned as shown in FIG. 1, limit switch contact 120*a* is open to effect deenergization of relay 146. The clutch coil 92*a* of the electromagnetic clutch unit 92 of set 18 then receives full voltage through the contacts 146*b* and 149*a*. The clutch coil 94*a* for the electromagnetic clutch unit 94 associated with flight bar set 20, on the other hand, then received reduced voltage through switch contacts 146*c* and 151*a*.

The incoming tray interrupts the photoelectric unit 140 long enough for both sets 18 and 20 of flight bars to advance off of their associated limit switches. Limit switch 118 closes to allow relays 148 and 149 to be held in through switch contact 148*c*. Limit switch 116 closes to allow relays 150 and 151 to be held in through switch contact 150*c*. As a result, both flight bar sets 18 and 20 move in unison as the incoming tray becomes overwrapped with film sheet 12 from the roll 14. Flight bar 18 advances until it engages limit switch 114, which opens to deenergize relays 148 and 149. Relay contact 149*a* then opens to deenergize clutch coil 92*a* of clutch 92 and relay contact 148*a* opens to deenergize brake coil 93*a*, thereby to engage the brake 93. Since the set of flight bars 20 has a greater distance to travel than the set of flight bars 18, the set of flight bars 20 continue moving after the set of flight bars 18 has stopped until limit switch contact 120*b* is opened. Relays 150 and 151 are deenergized, opening contact 151*a* to deenergize clutch coil 94*a* and thereby deactivate clutch 94, and opening contact 150*a* to deenergize brake coil 95*a* and thereby to engage brake 95. Simultaneously, limit switch contact 120*a* has been closed to energize relays 146 and 152. Relay contact 146*a* then is closed and relay contact 146*b* is opened, switching the voltage available to clutch coil 92*a* of clutch 92 from high to low. Relay contact 146*c* is opened and relay contact 146*d* is closed, thereby making high voltage available to coil 94*a* of clutch 94. Contact 152*a* is closed to hold relays 146 and 152 energized throughout the next wrapping cycle.

As a consequence of these operations, the incoming tray 8*b* has not been completely overwrapped with film and the flight bars engaging the leading and trailing sides of the tray are providing heat and pressure to weld the film sheet to the tray. Tray 8*a* has been released to the heating tunnel 6, and the compression and heating section 4 is ready to accept another filled tray that is indicated in FIG. 1 at 8*c*.

When the next tray 8*c* to enter the compression and heating section 4 interrupts the light beam to the photoelectric unit 140, relays 148, 149, 150 and 151 are again energized. Relay contacts 148*a* and 150*a* are closed to disengage brakes 92 and 94, respectively. Relay contact 149*a* is closed to provide an energization circuit to clutch coil 92*a*, on low voltage, through relay contact 146*a*, since relay 146 is still energized. Relay contact 151*a* is closed to energize clutch coil 94*a*, on high voltage, through relay contact 146*d*. As the flight bars move off the limit switches, the light beam to the photoelectric unit 140 remains blocked long enough to allow relays 148, 149, 150 and 151 to be held in through their respective holding circuits. Limit switch contact 114 closes so that relays 148 and 149 are held in through contact 148*c*. Relay contact 120*b* is closed and relays 150 and 151 are held in through contact 150*c*. Both sets 18 and 20 of flight bars advance in unison until flight bar 20*b* engages limit switch 116, deenergizing relays 150 and 151. Relay contact 151*a* opens, deenergizing clutch coil 94*a* and hence, deactivating clutch 94, and relay contact 150*a* opens to deenergize brake coil 95*a*, thereby resulting in engagement of brake 94. The set of flight bars 18 continue to advance until limit switch contact 118 is opened. Relays 148 and 149 are deenergized, opening contact 149*a* to deactivate clutch 92, and opening contact 148*a* to effect engagement of brake 93. When limit switch 118 opens relays 146 and 152 are deenergized. Contacts 146*a* and 146*d* are opened, while contacts 146*b* and 146*c* are closed, thereby switching the packaging machine back to the initial mode shown in FIGS. 1 and 7 for the next tray. The cycle is repeated for every two trays discharged to the heating tunnel 6.

Two time delay relays desirably are employed as safety devices for the adjustable packaging machine, as described further hereinafter. The first time delay relay, designated 154, has a contact 154*a*, and is used to overcome a "circuit race", which would tend to allow the flight bars of sets 18 and 20 to get out of synchronization when power is applied to the machine. When the "ON-OFF" switch 124 is turned on, relay 154 immediately becomes energized. Relay contact 154*a* closes after a short delay. This prevents the brake coils or solenoids 93*a* and 95*a* from being energized due to a transient pulse from the photoelectric cell or unit 140 which would have caused relays 148 and 150 to become briefly energized. During normal operation, relay 154 remains energized continuously. As a consequence, relay contact 154*a* remains closed and does not interfere with the actuation of the brakes.

The second time delay relay, designated 156, has a contact 156*a*. This time delay relay is used in a so-called "JOG" cycle, the establishment of which is effected by depressing a "JOG" switch 158 having three switch contacts 158*a*, 158*b* and 158*c*. If operating conditions are otherwise satisfied, and the main drive motor 84 for conveyor 10 is not already running, closure of contacts 158*a* and 158*b* energizes relays 148, 149, 150 and 151. This allows the flight bars of sets 18 and 20 to advance as described above. Time delay relay 156 is energized and contact 156*a* opens after a brief delay. The "JOG" contacts 158*a*, 158*b* and 158*c* thus no longer are operational, and relays 148, 149, 150 and 151 remain held in through their respective holding circuits. If the flight bars 18 and 20 are in synchronization, the machine functions normally, stopping after each cycle. To repeat a cycle, the "JOG" switch 158 must be depressed again, as the opening of switch contact 156*a* prevents the machine from operating continuously by maintaining the "JOG" switch depressed.

If the flight bars 18 and 20 are out of synchronization, depressing the "JOG" switch 158 repeatedly causes the flight bars to get back into synchronization. Desirably, the machine is allowed to complete each "JOG" cycle before the "JOG" switch is again depressed.

Also connected across the line is "infeed" switch 160 having "MANUAL", "OFF" and "AUTO" (Automatic) positions, the manual position of which is provided with a spring return. The switch 160 is connected across the line in series with a contact 84*a*, a limit switch 161 and relay 162. Switch 84*a* is closed upon energization of motor 84. Limit switch 161 is normally closed but is opened if there is a defective tray, for example, in which the articles are not properly inserted and protrude unduly from the tray. Specifically, as seen in FIG. 1, limit switch 161 is located adjacent the entrance of conveyor 10, and is actuated by an arm 161*a* which is arranged in the path of such protruding articles. A switch contact 163 is provided also for stopping the infeed conveyor motor in the event of a downstream backlog. Turning the switch 160 to its automatic position results in energization of the relay 162. This opens a contact to deenergize a brake coil (not shown) of the infeed conveyor motor. Another contact also closes upon energization of relay 162 to energize the drive clutch for the infeed motor. This results in normal driving of the infeed belt conveyor.

If there is a downstream backlog, or if the limit switch 161 opens, however, the infeed belt conveyor motor is deenergized, preventing any additional trays from entering the packaging machine. The spacing conveyor 10 continues to run allowing all trays 8 in transit to enter the film sheet supply station 2 and the compression and heating station 4.

If the reason for the pacing belt being stopped is a downstream backlog, the conveyor automatically restarts after the jam has been cleared. If the stoppage is due to opening of the limit switch 161, the conveyor 10 restarts once the defective tray has been removed, and the switch 161 has been allowed to close.

Figure 9:
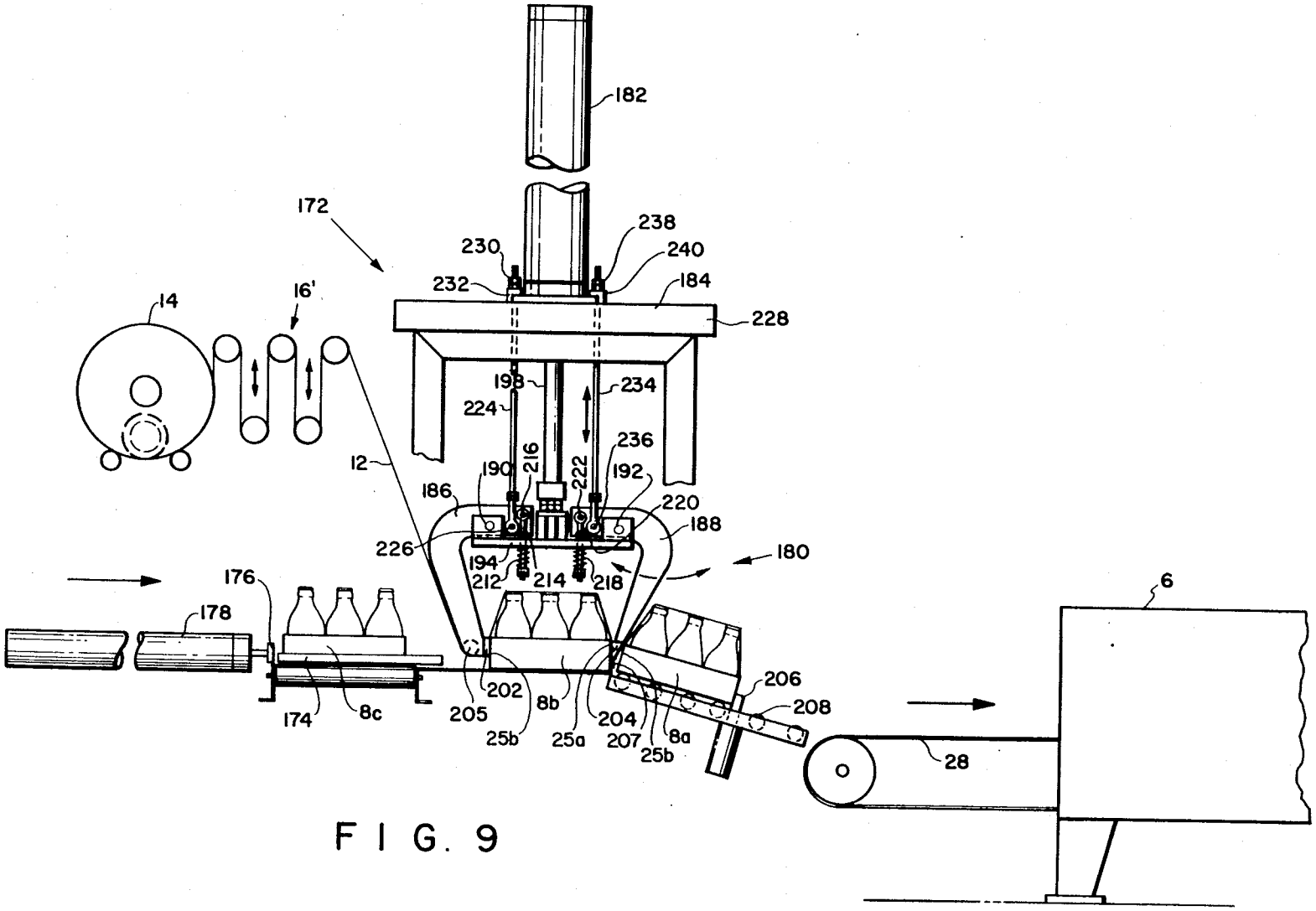
FIG. 9 is a view in elevation of the machine of FIG. 8.

Turning now to the embodiment of the invention illustrated in FIGS. 8 and 9, there is shown a packaging machine 164 which includes in sequence a feeder conveyor belt 166, a driven roller speed-up conveyor 168, a transfer station 170 for changing the direction or path of tray travel, a film supply 16', a compression and heat bonding station 172, and a heat tunnel 6. The driven roller speed-up conveyor 168 moves filled trays 8 faster than the feeder belt 166 whereby each of the trays 8, in succession, is separated from those that are following along preparatory to abruptly changing the direction of movement of each such tray 8 at transfer station 170, and delivering the tray to compression and heat bonding station 172. Specifically, at the transfer station 170, the tray 8*c* then on the driven roller conveyor 168 comes to a halt upon engagement with an abutment 174. Immediately thereafter a bar 176 disposed adjacent the wall 25*b* of the tray 8*c*, as seen in FIG. 8, is actuated by a tray transfer pusher cylinder 178 to push the tray 8*c* to the right, in a direction disposed substantially at a right angle with respect to the direction of movement of the tray into the transfer station 170, and push the tray 8*c* into the film supply 16', and compression and heat bonding station 172.

By reference to FIG. 9, it is seen that at the film supply 16' there is provided a film sheet 12 which is arranged to be drawn from a roll 14 of film sheet through a constant-tension film-unwinding device which may be similar to film unwinding device 16 illustrated in greater detail in FIG. 1.

The tray transfer pusher cylinder 178 may be a horizontally reciprocated air cylinder that pushes the incoming tray 8c against the film sheet 12 and a preceding tray 8b that, in FIG. 9, is shown in the compression and heat bonding station 172.

In the compression and heat bonding station 172 there is provided a sealing head 180 for tightly drawing the film sheet 12 over the top of each of the article-filled trays and bonding the film to the walls 25a, 25b of the trays. The sealing head 180 is vertically reciprocated by a sealing head lift cylinder 182 that is air operated and is mounted on an upright structure 184. The sealing head 180 includes two sets of inverted L-shaped hinged clamping arms 186 and 188 hinged on shafts 190 and 192 to cross bars 194. Flight bars 202 and 204 are mounted on the lower ends of the sets of arms 186 and 188, and extend across the width of tray 8b, as seen in FIG. 8. Flight bar 202 is connected between clamping arms 186, and a roller 205 allows film web 12 to move easily down from tension device 16 and across bar 202. Flight bar 204 is connected between clamping arms 188 and is wedge-shaped in cross section, as seen in FIG. 9, to accommodate the wedge-shaped angular displacement between trailing wall 25b of tray 8a and leading wall 25a of tray 8b caused by skate wheel conveyor 208 that slopes sharply downwardly. Skate wheel conveyor 208 is purposely sloped at a somewhat extreme angle to allow an opening between the trailing wall 25b of tray 8a and the leading wall 25a of tray 8b so that wedge-shaped bar 204 can find its way between the two tray walls. Bar 204 also contains a film slicing device 207 similar to that shown in FIG. 4 as 50 and 52. This device 207 is air operated. Flight bar 202 in the lowermost position of the sealing head 180, engages the trailing wall 25b of the tray 8b, as seen in FIG. 9, and is effective, in cooperation with the flight bar 204 to place the tray 8b in compression, with the film sheet 12 in engagement with the leading wall 25a and the trailing walls 25b of the tray 8b. Desirably, flight bars 202 and 204 are each provided with pressure pads. Such pressure pads may be similar to the pressure pads 34 and 36 provided in association with the flight bar sets 18 and 20 described hereinbefore, and include suitable heating means to effect the desired heat-bonding of the film sheet to the tray.

When the film sheet between trays 8a and 8b, as seen in FIG. 9, has been severed by slicing device 207, the sealing head 180 is lifted by the sealing head lift cylinder 182 to release the pressure on the leading and trailing walls of tray 8b. Simultaneously, an adjustable case stop 206 is lowered out of the way of the leading tray 8a to release tray 8a for movement downwardly by gravity along a skate wheel conveyor 208 to connecting conveyor 28 and thereby to heat tunnel 6. When the tray 8a has moved on to the conveyor 28, the adjustable case stop 206 again is moved upwardly to its stopping position as shown in FIG. 9.

When, subsequently, the next tray 8c is moved into compression and heat bonding station 172 by the case transfer pusher cylinder 178, film sheet 12 is drawn from the roll 14 over the top of the filled bottles in incoming tray 8c. As tray 8c is pushed into the position formerly occupied by tray 8b, tray 8c pushes tray 8b onto skate wheel conveyor 208, into the position formerly occupied by tray 8a. The movement of tray 8b is halted by stop 206.

Subsequent downward movement of the sealing head 180 draws the film sheet 12 over the tops of the filled bottles in tray 8c. As the clamping arms 186 and 188 move downwardly, the film sheet 12 is drawn tightly over the tops of the bottles by the flight bars 202 and 204. The clamping arms 188 rotate clockwise to filmly press the film sheet 12 against the leading wall 25a of tray 8c. This action in addition to a counterclockwise rotation of hinged arms 186 about their shafts 190 places the tray 8c under compression with the film sheet 12 pressed against the leading and trailing walls 25a–25b of the tray. Simultaneously, the pressure pads associated with the flight bars 202 and 204 impart heat to the film sheet and the adjacent tray walls in the manner described hereinbefore, thereby to effect a bond between the film sheet and the leading and trailing walls of the tray 8c with which the film sheet is in engagement.

Each of the clamping arms 186 is held in a normally open or spread apart position by a spring 212 which is mounted on a rod 214 that is pivotally attached to clamping arm 186 at pin 216. Rod 214 passes through a hole in cross bar 194 and the spring 212 bears against the bottom of cross bar 194 to pull the inner end of clamping arm 186 downwardly and thereby move flight bar 202 outwardly.

Similarly, each of the clamping arms 188 is held in a normally open position by the action of a spring 218 which is mounted on a rod 220 that passes through a hole in cross bar 194 and is pivotally connected to clamping arm 188 at pin 222. The spring 218 presses against the bottom of cross bar 194 to pull pin 222 downwardly and to pull the inner end of clamping arm 188 downwardly about its pivot pin or hinge shaft 192.

Each of the clamping arms 186 is also provided with an adjustable pull rod 224 which is attached to the horizontal portion of clamping arm 186 by a pivot pin 226. Pull rod 224 extends upwardly through a hole in cross member 228 and is provided near its end with adjustable lock nut 230 which may be positioned along the length of rod 224 as desired. A stop collar 232 is mounted on top of cross member 228 and is adapted to be contacted by lock nut 230 to limit the downward movement of pull rod 224.

Similarly, each of the pair of clamping arms 188 is provided with an adjustable pull rod 234 which is connected to the horizontal portion of clamping arm 188 by a pivot pin 236 and extends upwardly therefrom through a hole in cross member 228. The upper end of pull rod 234 is provided with adjustable lock nut 238, and a stop collar 240 is mounted on top of cross member 228 and adapted to be contacted by lock nut 238 to limit the downward movement of pull rod 234.

In operation of sealing head 180, the sealing head lift cylinder 182 pushes the sealing head downwardly, from its uppermost position toward the tray 8b below, with the clamping arms 186, 188 in their spread apart position. When the lock nuts 230, 238 contact the stop collars 232, 240, the downward movement of piston rod 198 continues, and the pull rods 224, 234 pull the inner ends of clamping arms 186, 188 upwardly against the force of the springs 212, 218 to rotate the lower ends of clamping arms 186 and 188 about their pivot shafts 190, 192 to move flight bars 202 and 204 towards each other to clamp film sheet 12 against the walls 25*a* and 25*b* of the tray 8*b*.

After the film sheet 12 has been welded to the walls of the tray, film slicing device 207 is operated to slice the film sheet between trays 8*a* and 8*b*, and the flight bars 202 and 204 are released from pressing against the walls of the tray 8*b*. Sealing head cylinder 182 moves its piston 198 upwardly and the initial movement upwardly allows springs 212 and 218 to pull down the inner ends of clamping arms 186 and 188 against the top of cross bars 194, since the initial upper movement of sealing head 182 has released the pull rods 224, 234.

Adjustable case stop 206 is depressed to permit tray 8*a* to move downwardly onto conveyor 28 which delivers the tray 8 to the heat tunnel 6. Tray transfer pusher cylinder 178 pushes tray 8*c* into the position beneath sealing head 182, and tray 8*c* pushes tray 8*b* onto skate wheel conveyor 208 against stop 206.

In addition to, or instead of the rollers 32 provided at the exit of the heat tunnel 6, illustrated in FIG. 5, for flattening out rough ears and effecting a bond of the shrunken side portions 242 of the film sheet 12 with the tray sidewalls 25*c*, mechanism 29 illustrated in FIGS. 10 and 11 may be provided for smoothing and shaping the loosely hanging film sheet side portions 242 at the tray sidewalls 25*c*, and hence, improving the appearance of the completed package. This mechanism neatly tucks loosely hanging side portions 242 of the film sheet against the sidewalls 25*c* of the trays 8 prior to passage of the tray into the heat tunnel 6.

As seen in FIG. 10, this mechanism includes a pair of heated rollers 244 positioned adjacent opposite sidewalls 25*c* of the tray in the path of tray travel, and a pair of kickers or tuckers 246 which also are positioned on opposite sides of the tray. As the tray moves forward into a position where the rollers 244 engage the leading side portions 242*a*, the rollers 244 press the leading side portions 242*a* of film sheet 12 against the sidewalls 25*c* and the combined pressure and heat of rollers 244 weld portions 242*a* neatly to sidewalls 25*a*. Also tuckers 246 are rotated to tuck trailing side portions 242*c* flat against sidewalls 25*c* so the leading edge of trailing side portion 242*c* is led smoothly into the bight of roller 244 as shown in FIG. 11, and the rollers 244 weld trailing side portions 242*c* to sidewalls 25*c*. Middle portion 242*b* of film sheet side portions 242 flops down and attaches to welded portions 242*a* and 242*b* in the heat tunnel 6. If side portions 242 are wide enough, middle portion 242*b* contacts tray sidewalls 25*c*. In heat shrinking, middle portion 242*b* may bunch and be rough in appearance, and roller 32, FIG. 5, will iron out this roughness while welding middle portion 242*b* to tray sidewalls 25*c*.

If it is desired to provide a completely enclosed package, such as the package 250 illustrated in FIG. 13, the apparatus 31 shown in FIG. 12 may be used. The tray 8 is provided with outwardly extending film sheet side portions 252 that are wide enough so that they make contact with tray sidewalls 25*c* when side portions 252 are disposed vertically.

Side portion tucker station 31 includes a pair of heated rollers 254 disposed one on each side of the travel path of tray 8 and positioned so as to contact and press against the passing sidewalls 25*c* to heat and compress the film sheet 12 against the sidewalls and weld the film sheet thereto.

Before the tray passes between the rollers 254, film sheet tray side portions 252 are folded neatly against the sidewalls 25. The neatly folded side portions 252 are welded to tray sidewalls 25 by rollers 254 to present a neat, completely enclosed package without any bunchiness or roughness in the film sheet.

To accomplish this a pair of fixed shoes 256 are disposed one on each side of the path of tray travel. Shoes 256 are adapted to contact leading side portion 252*a* of the film sheet 12 and fold them neatly against sidewalls 25*c* as tray 8 is being moved along by its conveyor 28. A pair of tuckers 258 are positioned one on each side of the passing tray and are adapted to contact and fold trailing side portion 252*c* against sidewalls 25*c*. Then a pair of plows 260, positioned one on each side of the moving tray, contact the middle portion 252*b* of the film side portion and plow it downwardly into contact with sidewalls 25*c* of the tray 8. Then the tray 8, with its side portions 252 tucked and folded neatly against sidewalls 25*c*, is passed between heated rollers 254 which apply heat and pressure against the neatly folded side portions 252 and the sidewalls 25*c* to weld the side portions 252 against sidewalls 25*c* and produce a completely enclosed package with the film sheet neatly folded and welded to the sidewalls 25*c* and to the leading and trailing walls 25*a* and 25*b*. The package 250 is then conveyed through the heat tunnel for shrinking the neatly applied film sheet.

Thus, there is provided in accordance with the present invention an improved method of and apparatus for forming a tight package of article-filled rectangular paperboard trays in accordance with which adherence of a film sheet for covering and holding the articles in the tray is produced by applied pressure and heat without the addition of glue or any other adhesive.

The improved apparatus of the present invention is characterized in its provision of independently driven heated flight bars for engaging the leading and trailing walls of each of successive trays whereby a tight bond is effected between leading and trailing walls of a tray and a sheet film which is drawn over each of said successive article-filled trays by the action of the flight bars, and whereby the packaging machine inherently is adjustable and accommodates trays of different sizes within the range of the machine.

Thin polyethylene, such, for example, as, Dow Polyfilm, manufactured by Dow Chemical Company, Midland, Mich., or VisQueen film, treated on at least one side to more easily accept printing ink, made by the VisQueen Division, Ethyl Corporation, Baton Rouge, La., have been found satisfactory for use as the film sheet 12. However, it is noted that the improved packaging machine described herein may, in some cases, employ film sheets of other manufacturers, types and materials, including stretch film and those made of paper. The heat or shrink tunnel 6 may be eliminated when heat shrinkable film is not used.

Where the film sheet material itself is incapable of forming a bond with paperboard tray walls, even in the presence of applied pressure and heat as described, the improved packaging machine nevertheless may be used to advantage with trays having outer wall coatings with which the film sheet reacts in the presence of applied pressure and heat to form a bond. With trays having a coating of polyethylene on their outer walls, film sheet made of paper may be employed as the covering material for the trays. Conversely, the polyethylene coating may be applied to the covering paper sheet or to both of the sealing surfaces.

I claim:

1. A multi-unit package comprising:

a paperboard tray including a bottom wall and a pair of spaced apart upstanding flexible side walls along opposite sides of the bottom wall;

a group of articles such as cans, bottles and the like on said bottom wall between said side walls; and a flexible film sheet extending over said group of articles and overlapping both of said tray side walls, bonding sections of those portions of said film sheet overlapping said side walls bonded thereto by the substance of said bonding sections with a substantially continuous bond extending along substantially the entire length of each of said side walls, said bond having a height less than the height of said side wall and located adjacent that edge of said side wall opposite said bottom wall, an unattached portion of said film sheet left between said bond and the bottom wall, said continuous bond having been formed by pressing said bonding sections of said film sheet to be bonded against said side walls with a substantially constant pressure along the length of said side wall while simultaneously heating said bonding sections of said film sheet to bonding temperature and while maintaining said film sheet taut over said articles.

2. The multi-unit package of claim 1 wherein said film sheet is heat shrinkable, said film sheet having been heat shrunk over the group of articles after formation of said bonds to cause said film sheet to lock said articles in place in said tray.

3. The multi-unit package of claim 2 wherein said paperboard tray includes a pair of spaced apart upstanding end walls along opposite ends of the bottom wall and wherein said flexible film sheet further overlaps at least a portion of said tray end walls, said film sheet overlapping said tray end walls having been bonded to said end walls.

* * * * *